US006692318B2

(12) United States Patent
McBride

(10) Patent No.: US 6,692,318 B2
(45) Date of Patent: Feb. 17, 2004

(54) MIXED FLOW PUMP

(75) Inventor: Mark W. McBride, Bellefonte, PA (US)

(73) Assignee: The Penn State Research Foundation, University Park, PA (US)

( * ) Notice: Subject to any disclaimer, the term of this patent is extended or adjusted under 35 U.S.C. 154(b) by 41 days.

(21) Appl. No.: 10/165,128

(22) Filed: Jun. 7, 2002

(65) Prior Publication Data

US 2003/0228214 A1 Dec. 11, 2003

Related U.S. Application Data

(60) Provisional application No. 60/348,359, filed on Oct. 26, 2001.

(51) Int. Cl.[7] ..... B63H 11/00

(52) U.S. Cl. ..... 440/38; 440/47; 415/191

(58) Field of Search ..... 440/38, 40, 42, 440/43, 47; 415/191, 192, 193, 199.1, 208.2, 211.2

(56) References Cited

U.S. PATENT DOCUMENTS

| | | | | | |
|---|---|---|---|---|---|
| 3,939,794 | A | | 2/1976 | Hull | 115/16 |
| 4,063,849 | A | * | 12/1977 | Modianos | 415/210.1 |
| 4,427,338 | A | | 1/1984 | Furst | 415/210 |
| 4,831,297 | A | | 5/1989 | Taylor et al. | 310/87 |
| 4,929,200 | A | | 5/1990 | Guezou et al. | 440/38 |
| 5,417,547 | A | | 5/1995 | Harada | 415/208.4 |
| 5,480,330 | A | | 1/1996 | Brown | 440/38 |
| 5,645,008 | A | | 7/1997 | Loui | 114/274 |
| 5,947,680 | A | | 9/1999 | Harada et al. | 415/17 |
| 6,102,757 | A | | 8/2000 | Ishigaki | 440/47 |
| 6,168,485 | B1 | | 1/2001 | Hall et al. | 440/89 |
| 6,203,388 | B1 | | 3/2001 | Sinko et al. | 440/6 |
| 6,238,257 | B1 | * | 5/2001 | Platzer et al. | 440/42 |
| 6,254,359 | B1 | * | 7/2001 | Aber | 417/356 |
| 6,263,819 | B1 | | 7/2001 | Gorustein et al. | 114/61.3 |
| 6,267,632 | B1 | | 7/2001 | Blanchard | 440/38 |
| 6,273,768 | B1 | | 8/2001 | Blanchard | 440/38 |
| 2001/0031210 | A1 | * | 10/2001 | Antaki et al. | 417/356 |
| 2002/0005156 | A1 | * | 1/2002 | Duncan | 114/151 |

OTHER PUBLICATIONS

"Tiny Pumps Keep Heart Patients Alive", *Machine Design*, Oct. 11, 2001, www.machinedesign.com.

Shepherd, D.G. "Principles of Turbomachinery" The Macmillan Company, 10$^{th}$ Printing, 1971, 1956(copyright).

* cited by examiner

*Primary Examiner*—Stephen Avila
(74) *Attorney, Agent, or Firm*—Woodcock Washburn LLP

(57) ABSTRACT

The present invention relates to propulsion and hydraulic systems having a co-axial design wherein the inlet section, impeller section, and outlet section of a mixed flow pump system all have a common centerline axis or axis of rotation. The mixed flow pump system includes an outer casing and a central body disposed co-axially within the outer casing. A pump impeller is rotatably connected to the central body for imparting hydraulic energy to the fluid flowing through the mixed flow pump system. The mixed flow pump system may also include inlet flow conditioning vanes for conditioning an inlet flow of fluid to the mixed flow impeller for improving the cavitation performance and/or acoustic performance of the pump module. Stator vanes are provided for connecting the central body to the outer casing and to remove any swirl velocity from the fluid flow exiting the mixed flow pump impeller. The mixed flow pump system exhibits improved resistance to cavitation due to the use of one or more of inlet flow conditioning vanes and low RPM motors for rotating the mixed flow pump impeller. The invention has applications in a variety of applications, including propulsion and hydraulic applications. For example, the invention may be used for the propulsion of marine vehicles, such as submerged crafts, weapons and unmanned underwater vehicles (UUVs) of various sizes and speed requirements. The mixed flow pump may also be applied to non-marine applications such as hydraulic applications, chemical distribution systems, and medical devices.

30 Claims, 10 Drawing Sheets

MIXED FLOW PUMP

This application claims benefit under 35 U.S.C. §119(e) to Provisional Application No. 60/348,359 filed on Oct. 26, 2001.

FIELD OF THE INVENTION

The invention relates generally to the field of pumps, and in particular, to improved mixed flow pumps for marine propulsion and hydraulic applications.

BACKGROUND OF THE INVENTION

Conventional propulsors include numerous propeller, pumpjet and water jet propulsion devices. These devices are typically powered by an engine at a distance from the propulsor that is connected by a shaft to the propulsor. The engine is typically contained within a ship hull or pressure hull. Usually, a drive shaft extends from the engine through the pressure hull to the propeller, and bearings and a pressure seal are required to support the shaft and provide water-tight integrity for the engine and hull. These conventional propulsors contain motors that are located inside the pressure hull and that are directly coupled to a propeller that is located outside the pressure hull, with the flow being an external, rather than an internal flow.

Some examples of prior art patents include U.S. Pat. Nos. 6,273,768; 6,267,632; 6,203,388; 6,168,485; and 3,939,794. For example, U.S. Pat. No. 6,273,768 teaches that it is known to propel a boat or other watercraft using a water jet apparatus mounted to the hull, with the powerhead being placed inside (inboard) or outside (outboard) the hull. The drive shaft of the water jet apparatus is coupled to the output shaft of the motor. The impeller is mounted on the drive shaft and installed in a housing, the interior surface of which defines a water tunnel having a convergent nozzle. The impeller is designed such that during motor operation, the rotating impeller impels water rearward through the water tunnel and out the convergent nozzle. The reaction force propels the boat forward.

Conventional pumps include radial, axial, and mixed flow pumps. In a typical axial flow pump, the radial distance of a fluid particle from the pump centerline is constant from the pump inlet to the pump outlet. In radial and mixed flow pumps, the radial distance of a fluid particle from the pump centerline increases along the length of the pump because these types of pumps typically include a scroll or spiral type casing. Mixed flow pumps typically have a discharge that is perpendicular to the axis of impeller rotation.

A problem with conventional propulsors is that they typically do not include any flow conditioning of the fluid flow entering the pump impeller. For example, it may be desirable to condition the inlet flow to affect pump performance in some way, such as to reduce cavitation and improve acoustic performance of the propulsor, increase the head rise potential of the pump, and the like. Cavitation is generally undesired in conventional pumping systems because cavitation results in lost thrust and acoustic noise.

For example, U.S. Pat. No. 5,947,680 discloses turbomachinery with variable angle inlet guide vanes and variable angle diffuser vanes. However, the turbomachinery disclosed in U.S. Pat. No. 5,947,680 only teaches straight inlet guide vanes that are controlled in conjunction with the diffuser vanes to control the angle of the vanes to suit an operating condition. Also, the turbomachinery disclosed in U.S. Pat. No. 5,947,680 has variable geometry vanes, not fixed geometry guide vanes. This design is to adjust the performance to an optimum over a range of operating points and does not, for example, provide superior performance at one operating point. The device disclosed in U.S. Pat. No. 5,947,680 also includes a scroll discharge casing.

Another problem is flow conditioning of the outlet flow exiting the pump impeller. For example, in radial and mixed flow pumps, the rotating impeller imparts swirl to the flow as the impeller rotates and this swirl velocity decreases the pump performance.

Conventional propulsion pumps include various means for straightening the fluid flow exiting the impeller. For example, U.S. Pat. No. 4,427,338 discloses thrust control vanes for waterjets. The flow straightening vanes of the waterjets pump are designed to produce a low-pressure area, and the downstream side of the rotor drum is located inside the low-pressure area to eliminate the need for an axial thrust control seal. Also, U.S. Patent No. 4,929,200 discloses fixed flow-correction guide vanes positioned downstream of a rotating impeller. A number of gas injection slots are situated in the area of the trailing edges of the vanes for introducing a volume of gas into the flow in the tail pipe section of the pump in order to reduce internal drag resulting from pressure exercised by the water against the pump casing. U.S. Pat. No. 6,102,757 discloses a water jet propulsion device for a marine vessel having guide vanes provided in the water passage in the rear of the impeller for converting the guided swirl flows exiting the impeller into straight flows. U.S. Pat. No. 5,417,547 discloses a vaned diffuser for centrifugal and mixed flow pumps having two rows of radially displaced vanes to more efficiently convert the kinetic energy of the fluid flowing out from the impeller into static pressure. In addition, U.S. Pat. No. 5,480,330 discloses using a second impeller located rearward of a first impeller and which serve to straighten the rearwardly directed water flow.

Therefore, a need exists for a mixed flow pump having improved pump performance, reduced cavitation, and improved acoustics performance. The need also exists for a co-axial mixed flow pump.

SUMMARY OF THE INVENTION

The present invention is directed to a co-axial mixed flow pump system having one or more of improved pump performance, reduced caviatation, and reduced acoustic noise. The mixed flow pump includes an outer casing having a longitudinal centerline axis and a central body aligned co-axially within the outer casing along the longitudinal centerline axis. An axial forward looking inlet is formed along the longitudinal centerline axis for receiving a flow of fluid. A mixed flow pump having an impeller rotatably mounted to a forward end of the central body. The mixed flow impeller includes a hub, a plurality of blades extending outward from the hub, and a plurality of flow passages formed between adjacent blades. The mixed flow pump impeller rotates about the longitudinal centerline axis to draw a flow of fluid into the mixed flow impeller through the inlet and imparts energy to the fluid flow. An annular passageway is formed between the outer casing and the central body on a downstream side of the mixed flow pump impeller for receiving the fluid flow exiting the mixed flow impeller. The annular passageway is aligned axially. A plurality of stator vanes are disposed between and connecting the outer casing and the central body to condition the flow exiting the mixed flow impeller to flow generally in the axial direction. The mixed flow pump system also includes an axial rearward looking outlet formed along the longitudinal centerline axis for discharging the flow of fluid from the mixed flow pump system.

According to one aspect of the invention, the mixed flow pump, further includes an inlet section extending forward of the axial forward looking inlet. The inlet section has a distal inlet opening at a forward end and a length of inlet ducting connecting the inlet opening to the mixed flow pump impeller. In an alternate embodiment, the inlet section can further include a flush type inlet upstream of the axially aligned inlet to the mixed flow pump.

According to another aspect of the invention, the mixed flow pump can further include a plurality of inlet flow conditioning vanes disposed in the inlet section to condition a fluid flow flowing into the mixed flow pump impeller. The inlet flow conditioning vanes can be connected at a first end to the inlet ducting and extending into the inlet ducting to a distal end. The inlet flow conditioning vanes can comprise straight vanes attached to and extending radially inward from the outer casing into the fluid flow to eliminate any distortions in the fluid flow.

According to another aspect of the invention, the inlet flow conditioning vanes can comprise curved vanes that are curved in the same direction as the direction of impeller rotation to impart swirl to the fluid flow entering the mixed flow pump impeller to reduce the relative velocity of the fluid flow in order to decrease cavitation and vibration noise. In an alternative embodiment, the inlet flow conditioning vanes can comprise curved vanes that are curved into a direction of impeller rotation to impart swirl to the fluid flow entering the impeller and to increase the relative velocity of the fluid flow entering the mixed flow pump impeller to increase the mixed flow pump head rise potential.

In accordance with another aspect of the invention, the inflow conditioning vanes extend radially into the inlet duct from the outer casing in a radial direction toward the centerline axis of the outer casing. Alternatively, the inlet flow conditioning vanes can be leaned in a circumferential direction as the inlet flow conditioning vanes extend into the inlet duct.

Furthermore, the mixed flow pump can further include a center member extending axially forward from the central body into the inlet section. In embodiments having a center member, the inlet flow conditioning vanes can extend radially and be connected between the center member and the outer casing.

In accordance with another aspect of the invention, fluid flow enters the mixed flow pump impeller axially, flows through the mixed flow pump impeller at an angle from the longitudinal centerline axis such that a pressure developed by the mixed flow pump impeller is developed partly by centrifugal force and partly by a lift of the impeller blades on the fluid, and discharges the mixed flow pump impeller axially.

According to another aspect of the invention, the mixed flow pump impeller blades can include an open blade construction having a clearance gap formed between a distal end of the impeller blades and the outer casing blades. In an alternate embodiment, the mixed flow pump impeller blades can include a shrouded blade construction having a shroud disposed at a distal end of each of the impeller blades. In yet another embodiment, the impeller blades can include an embedded shrouded blade construction, wherein the shrouds of the shrouded impeller blades extend into and rotate within a groove in the outer casing.

Furthermore, the mixed flow pump can include a drive motor that is mounted axially rearward of the mixed flow impeller in the fluid flow. The motor can be housed the central body. Alternatively, the motor can be mounted outside of the fluid flow and a drive shaft, gears, bearings, etc. can connect the motor to the pump impeller. In addition, a rim-drive type motor may be used to drive the mixed flow pump impeller.

The plurality of stator vanes supporting the central body within the outer casing can include a curved wing-like shape for helping to remove swirl velocity from the fluid flow exiting the mixed flow impeller and straightening the fluid flow to flow generally in the axial direction. Preferably, the stator vanes are positioned at equal spacing around a circumference of the central body.

Moreover, the mixed flow pump can include one or more fairings to help facilitate a smooth flow of fluid though the outer casing and around the central body. For example, an inlet fairing can be provided that extends forward from a front end of the central body toward the inlet section and provides smooth flow into the impeller section and around the central body. An outlet fairing can be provided that extends rearward from a rear end of the central body toward the outlet section in order to facilitate a smooth flow as the flow exits the annular passageway.

In accordance with another aspect of the invention, the mixed flow pump can further include an outlet section having a forward end proximate the axial rearward looking outlet and a length of outlet ducting connecting the annular passageway to a discharge nozzle. The discharge nozzle can be positioned in the outlet ducting proximal a discharge opening for accelerating the fluid flow as the fluid flow is discharged from the mixed flow pump.

In accordance with another embodiment within the scope of the present invention, a mixed flow pump is provided for inputting hydraulic energy to a fluid flowing therethrough. The mixed flow pump includes an outer casing aligned axially from a forward end to a rearward end. The outer casing includes an inlet section, an impeller section, and an outlet section.

The inlet section includes an axially aligned inlet opening at the forward end and an axially aligned inlet duct having a generally increasing cross-sectional area from a first end of the inlet duct proximal the inlet opening to a second end of the inlet duct.

The impeller section is connected to a downstream end of the inlet section. The impeller section includes an axially aligned impeller inlet connected to the second end of the inlet section. An impeller sweep area having a generally increasing circular cross-sectional area is defined between the impeller inlet and an impeller outlet.

The outlet section is connected to a downstream end of the impeller section. The outlet section includes an axially aligned inlet at a forward end of the outlet section connected to the impeller outlet and an axially aligned outlet duct having a generally decreasing cross-sectional area from the outlet section inlet to a discharge opening.

According to another aspect of the invention, a central body can be disposed within and co-axial with the outer casing. The central body includes a stationary hub disposed within the outlet section, a mixed flow pump impeller rotatably mounted to a forward end of the hub and in the impeller section for drawing a flow of fluid through the inlet duct and into the mixed flow pump impeller. An annular passageway is formed between the central body and the outer casing and in the outlet section. A stator blade assembly is disposed between and connects the central body and the outer casing to provide structural support for the central body, to remove any swirl velocity from the fluid flow exiting the mixed flow pump impeller, and to convert kinetic energy contained within the swirl velocity to pressure.

A drive motor is provided for driving the impeller hub, causing the impeller to rotate thereby adding hydraulic energy to the fluid flowing through the mixed flow pump.

Inlet flow conditioning vanes can be disposed in the inlet section to condition a flow of fluid into the mixed flow pump impeller. The inlet flow conditioning vanes can include curved vanes having a wing shape, wherein the curved vanes are oriented to curve or turn in the same direction as the direction of rotation of the mixed flow pump impeller, thereby reducing the relative velocity of the fluid flow entering the mixed flow pump and reducing cavitation, or the inlet flow conditioning vanes can curve or turn into the direction of rotation of the mixed flow pump impeller, thereby increasing the relative velocity of the fluid flow entering the mixed flow pump and increasing the head rise potential of the mixed flow pump.

The inlet flow conditioning vanes can extend radially into the inlet duct from the outer casing toward the longitudinal centerline. Alternatively, the inlet flow conditioning vanes can be leaned in a circumferential direction as they extend into the inlet duct.

In accordance with another embodiment of the present invention, a co-axial propulsion system for use in propulsion and hydraulic applications can be provided. The coaxial propulsion system includes an outer casing for containing and guiding a fluid flow within the co-axial propulsion system. The outer casing includes ducting having a longitudinal centerline. The outer casing has a forward looking, axial inlet opening centered about the longitudinal centerline for receiving an axial flow of fluid from one of an internal fluid system and an exterior fluid operating environment into an interior of the co-axial propulsion system. The outer casing also has a rearward looking, axial outlet opening centered about the longitudinal centerline for discharging an axial flow of fluid from the interior of the co-axial propulsion system to one of the internal fluid system and the exterior fluid operating environment. The ducting extends axially and connects the inlet opening and the outlet opening.

A central body is disposed co-axially within the outer casing, A mixed flow pump impeller is rotatably mounted to the central body and disposed co-axially about the longitudinal centerline, wherein an axis of rotation of the mixed flow pump impeller is co-axial with the longitudinal centerline of the outer casing. An annular passageway defined between the outer casing and the central body, the annular passageway being oriented co-axially about the longitudinal centerline.

A plurality of stator vanes are disposed co-axially the the longitudinal centerline and extend radially between the outer casing and the central body and also extend through the annular passageway. The stator vanes support the central body within the outer casing. The stator vanes are configured to remove swirl velocity from the fluid flow exiting the mixed flow impeller and straightening the fluid flow to flow in an axial direction toward the outlet opening.

In accordance with another aspect of the invention, the ducting further includes inlet ducting formed between the inlet opening and the impeller section and a plurality of inlet flow conditioning vanes disposed in the inlet ducting for conditioning a fluid flow to improve one or more of cavitation performance and acoustic performance of the co-axial propulsion system.

In accordance with another aspect of the invention, the ducting further includes outlet ducting and a discharge nozzle for discharging the fluid flow from the ducting to produce thrust, wherein the outlet ducting is formed between the impeller section and the outlet opening and wherein the plurality of stator vanes are disposed in the outlet ducting.

In a further embodiment of the invention a co-axial mixed flow pump system is provided for propulsion and hydraulic applications. The co-axial mixed flow pump system includes an outer casing axially aligned about a centerline axis, a central body disposed within the outer casing and aligned about the centerline axis. A mixed flow pump is rotatably mounted to a front end of the central body and has an axis of rotation that is coincident with the centerline axis. A plurality of stator vanes are disposed between and connect the outer casing and the central body for removing swirl velocity from a flow exiting the mixed flow pump and causing the exiting flow to flow in an axial direction.

The co-axial mixed flow pump system also includes an internal flow passage defined by the outer casing. The internal flow passage further includes an axially inlet flow passage, an axial inlet to the mixed flow pump, an axial discharge from the mixed flow pump, an axially aligned annular flow passage defined between the outer casing and the central body, and an axially aligned outlet flow passage.

Additional features of the present invention are set forth below.

DETAILED DESCRIPTION OF THE PREFERRED EMBODIMENTS

Figure 1:
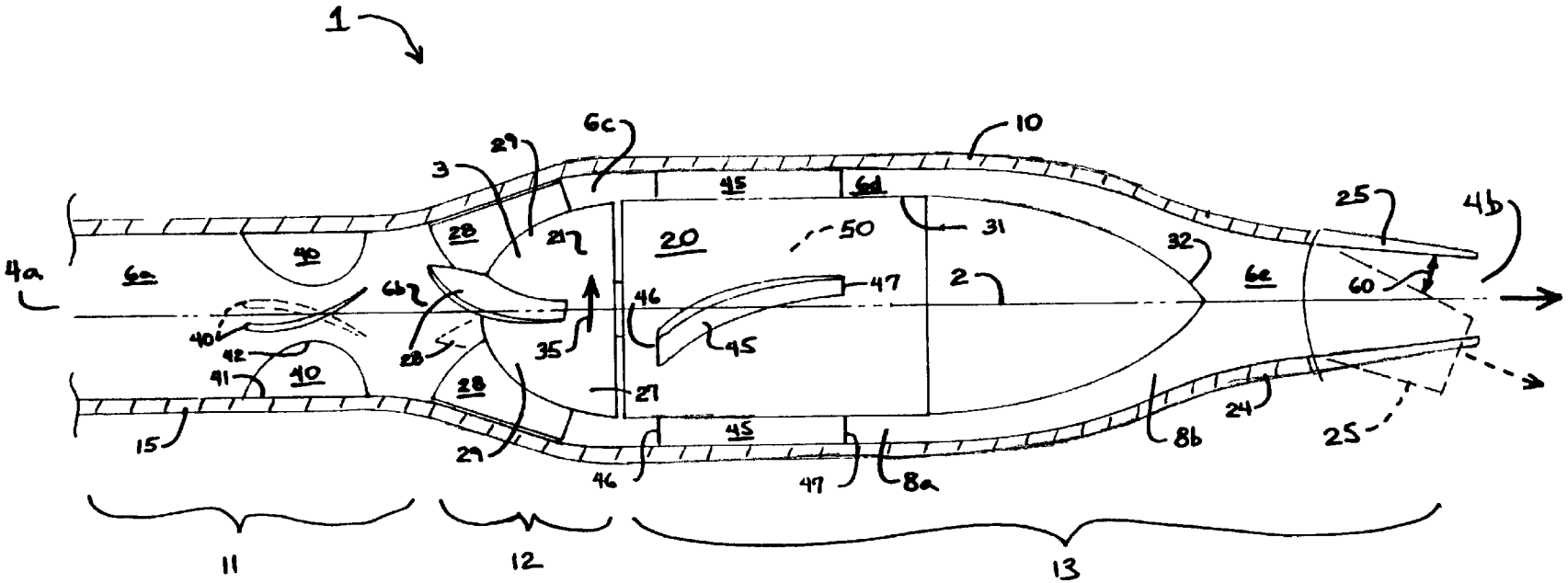
FIG. 1 shows a cross sectional view of an exemplary mixed flow pump.

In the illustrated embodiments of the invention shown in FIGS. 1–8, an improved mixed flow pump system 1 that provides advantages in pump operational performance, and improvements in cavitation and acoustic performance of the mixed flow pump system 1. As shown in the figures, the mixed flow pump system 1 includes an outer casing 10 aligned axially about an axial centerline axis 2 and a central body 20 disposed within and aligned about the same centerline axis 2 the outer casing 10. The mixed flow pump system 1 also includes a mixed flow pump 3 having an axis of rotation aligned axially and that is coincident with the centerline axis 2. Throughout the description, reference is made to a system inlet or forward end 4*a* where the fluid enters the mixed flow pump from and a system outlet or aft end 4*b* where the fluid exits the mixed flow pump system 1.

FIG. 1 shows a cross sectional view of an exemplary mixed flow pump system 1. As shown in FIG. 1, the outer casing 10 includes an internal flow passage comprising an optional axially aligned inlet flow passage 6*a,* an axial inlet 6*b* to the mixed flow pump 3, an axial discharge 6*c* from the mixed flow pump 3, an axially aligned annular flow passage 6*d* defined between the outer casing 10 and the central body 20, and an axially aligned outlet flow passage 6*e.*

The mixed flow pump system 1 can receive a flow of fluid from an internal system, such as a piping system, or an external fluid operating environment, such as a submersible vehicle operating in the ocean.

As shown in FIG. 1, the outer casing 10 includes an inlet section 11, an impeller section 12, and an outlet section 13. As shown in the figures, the inlet section 11 includes a generally increasing cross-section area for receiving a fluid flow into the internal flow passage 6*a*–6*e* of the outer casing 10.

The impeller section 12 is located aft (e.g., down stream) of the inlet section 11 and houses a mixed flow pump impeller 21 that rotates and adds hydraulic energy to a fluid as the fluid flows through the mixed flow pump impeller 21. The impeller section 12 includes a generally increasing circular cross section that extends over the impeller sweep area of the mixed flow impeller 21.

The outlet section 13 is located aft (e.g., down stream) of the impeller section 12 and includes a generally decreasing cross sectional area. As the flow exits the mixed flow impeller 21 it passes through the annular passageway 6*d* between the outer casing 10 and the central body 20. As shown in FIG. 1, the annular flow passage 6*d* includes a first or forward portion 8*a* having a generally constant diameter and generally constant cross sectional area and a second or after portion 8*b* having a generally decreasing diameter and a generally increasing cross sectional area.

The impeller section 12 drives the fluid through the outlet section 13 to a discharge nozzle 25 where the fluid is accelerated and dispelled from the outer casing 10 to produce thrust.

Preferably, the outer casing 10 and the central body 20 include circular shaped ducting and a circular shaped body, respectively. While the outer casing 10 in the impeller section 12 (e.g., the impeller sweep area) and rotating pump impeller 21 must be circular, the rest of the outer casing 10 (including sections 11 and 13) and central body 20 are not limited to a circular shape. For example, the inlet section and the outlet section need not be circular in shape, and can include other suitable shapes.

In one preferred embodiment, the mixed flow pump system 1 includes a coaxial design and construction. Co-axial means that there is a common centerline axis 2 for the various components of the mixed flow pump propulsion system 1. Preferably, the axis of rotation of the mixed flow pump impeller 21 is coincident with the centerline axis 2. A single centerline axis 2 exists around which the outer casing 10, central body 20, inlet section 11, impeller section 12, and outlet section 13 are symmetrically disposed and aligned (e.g., a common centerline axis 2 about which the system inlet opening 4*a,* optional inlet ducting 15, optional inlet flow conditioning vanes 40, mixed flow pump impeller 21, stator vanes 45, outlet ducting 24, and system outlet opening 4*b* are symmetrically disposed or aligned). In addition, in a preferred embodiment, a motor 50 for driving the mixed flow pump impeller 21 is also aligned about the same centerline axis 2 and is located in the fluid stream.

The co-axial mixed flow pump 3 includes a substantial straight-line flow in the axial direction into the mixed flow pump 3 from the pump inlet 6*b* and out of the pump outlet 6*c.* In addition, the co-axial mixed flow pump system 1 preferably includes co-axial flow from the system inlet 4*a* and through the inlet section 11, through the outlet section 13 to the system outlet 4*b,* with the impeller section 12 with the mixed flow pump 3 disposed in between. Note that in the impeller section 12 there is flow in both an axial and radial direction (e.g., "mixed flow").

This design results in a co-axial mixed flow pump system 1 having an axial centerline axis 2 of symmetry about which the various components of the system are aligned and through which a fluid flows substantially axially from the system inlet 4*a* to the system outlet 4*b.* This is different than conventional mixed flow pumps that typically have a scroll type casing (e.g., a spiral snail shaped casing wherein the discharge flow is perpendicular to the axis of rotation of the impeller).

In one embodiment, the co-axial mixed flow pump system 1 can be located in a pod or modular propulsor having an internal flow of fluid through the mixed flow pump outer casing 10. Vectored thrust may be provided by a movable discharge nozzle, by moving the pod, and the like.

Inlet Section

Preferably, the mixed flow pump system 1 includes a forward looking, axial inlet to the mixed flow pump 3 (e.g., an inlet that is centered about the centerline axis 2 or axis of rotation of the mixed flow pump impeller), as shown in FIG. 1. In one embodiment, the mixed flow pump system 1 can received a flow from an internal environment (e.g., wherein the pump is located in a piping system and the piping before the pumps acts as the inlet per se and the flow transits from the piping to the domain of the mixed flow pump). In another embodiment, the inlet to the mixed flow pump can receive fluid flow directly from an external fluid operating environment directly into the mixed flow pump system 1 in the axial direction (e.g., a vehicle operating in an external fluid environment and receiving a flow from the fluid environment through the pump inlet to the pump domain).

Figure 2:
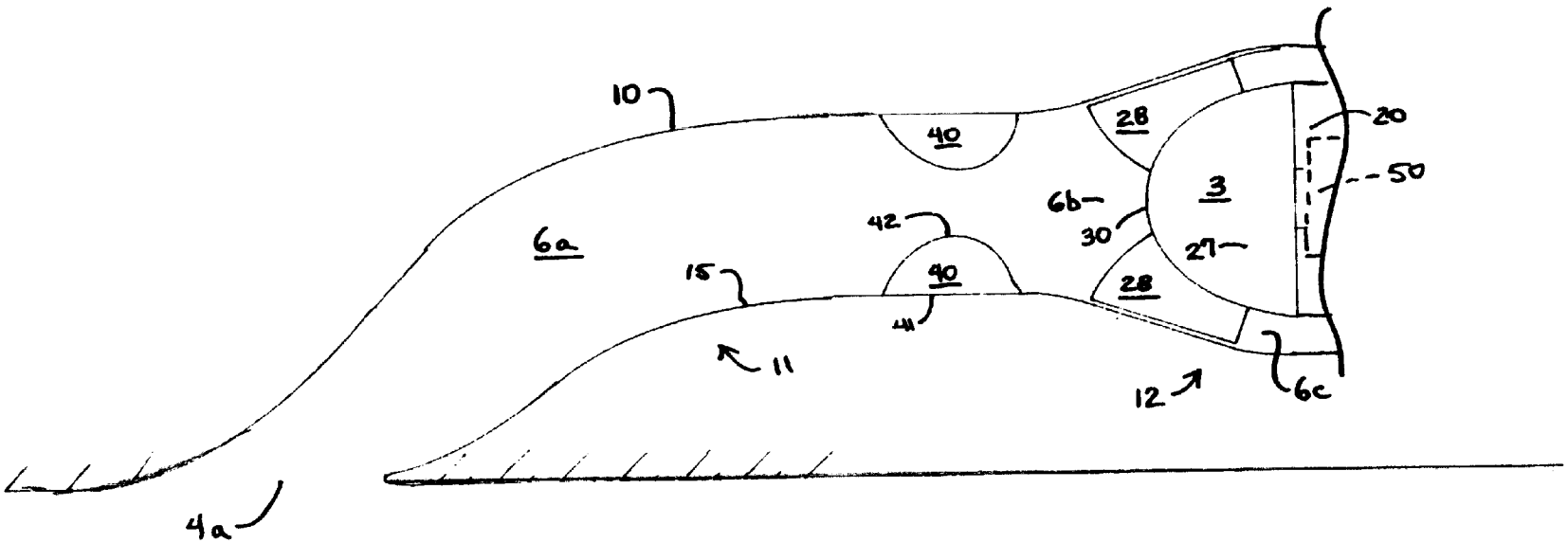
FIG. 2 shows a partial sectional view of another exemplary flow inlet to the mixed flow pump of FIG. 1.

FIGS. 1 and 2 show exemplary inlet sections 11 of the mixed flow pump system 1. FIG. 1 shows an embodiment of the mixed flow pump system 1 having a forward looking, axial type inlet. FIG. 2 shows an embodiment of the mixed flow pump system 1 having a flush type inlet as an alternative type of inlet that can be used with the mixed flow pump system 1. Where a flush type inlet is used, at least a portion of the inlet section 11 before the mixed flow pump 3 is aligned axially.

As shown, the inlet section 11 includes inlet ducting 15 for containing and guiding a flow of fluid through the inlet section 11 to the impeller section 12. The inlet ducting 15 includes a first end defining the system inlet opening 4*a* and a second end proximate the pump inlet 6*b*. Preferably, the inlet ducting 15 has a generally circular cross-section, although other shapes may be suitable. The inlet ducting 15 may include a constant cross sectional area or a generally increasing cross-sectional area from the first end to the second end.

In embodiments having inlet ducting 15 having a generally increasing cross-section, flow may be diffused by progressively increasing the flow area to increase the pressure and decrease the flow velocity, thereby improving cavitation performance in the mixed flow pump system 1. This can be accomplished, for example, by gradually increasing the diameter of a circular shaped outer casing from a first end of the inlet section 11 at the inlet opening 4*a* to a second end of the inlet section 11 connected to the impeller section 12.

Inlet Flow Conditioning Vanes

FIGS. 1 through 5 show inlet flow conditioning vanes 40 in the inlet section 11. As shown in FIG. 1, a plurality of inlet flow conditioning vanes can be disposed around the circumference of the inlet ducting 15 and extend inward into the fluid flow. Inlet flow conditioning vanes 40 are used to condition the flow as it proceeds to the impeller section 12. Conditioning means that the inward flow of fluid to the mixed flow pump is influenced in some way. For example, the flow conditioning vanes 40 can be used to eliminate distortions, to impart swirl to the flow to either reduce the relative velocity of the flow at the pump impeller inlet thereby reducing cavitation and noise, to increase the relative velocity of the flow to increase the pump energy input and efficiency, for structural support, and the like. The inlet flow conditioning vanes 40 may also help to keep debris out of the pump impeller 21.

So, depending on the particular application, inlet flow conditioning vanes 40 or a combination of flow conditioning vanes 40 can be used to improve the performance of the mixed flow pump system 1. The improved performance can be in the area of efficiency, cavitation, acoustics, etc. The inlet flow conditioning vanes 40 can make the difference between a good mixed flow pump system and an extremely good mixed flow pump system.

Preferably, the inlet flow conditioning vanes 40 are disposed in the inlet section 11 and extend radially into the fluid stream (e.g., along a line that is essentially a radial line from the casing toward the center of the inlet ducting 15). As shown in FIGS. 1, 2, 3, and 4A the inlet flow conditioning vanes are attached at a first end 41 to the outer casing 10 and extend radially into the fluid flow toward the center axis 2 of the pump casing 10 to a second or distal end 42.

Figure 4A:
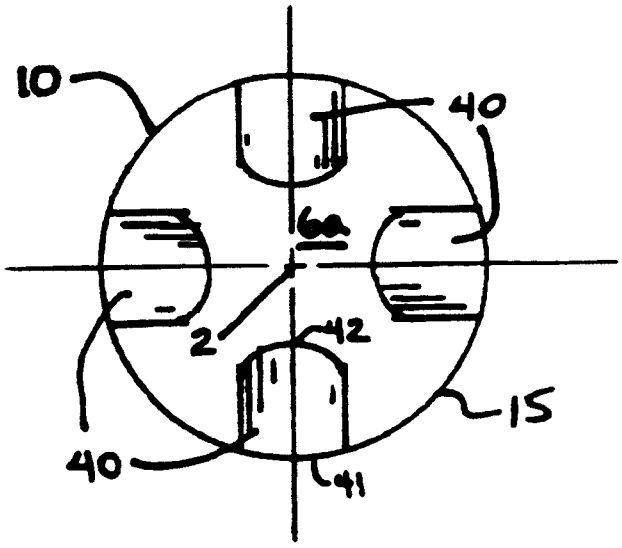
FIG. 4A shows exemplary inlet flow conditioning vanes extending radially inward from the inside circumference of the outer casing.

FIG. 4A shows four inlet flow conditioning vanes 40 having a cantilever type design wherein the inlet flow conditioning vanes 40 extend inward from the inside circumference of the outer casing 10 along a radial line extending generally radially to the longitudinal centerline axis 2 of the outer casing 10.

Figure 4B:
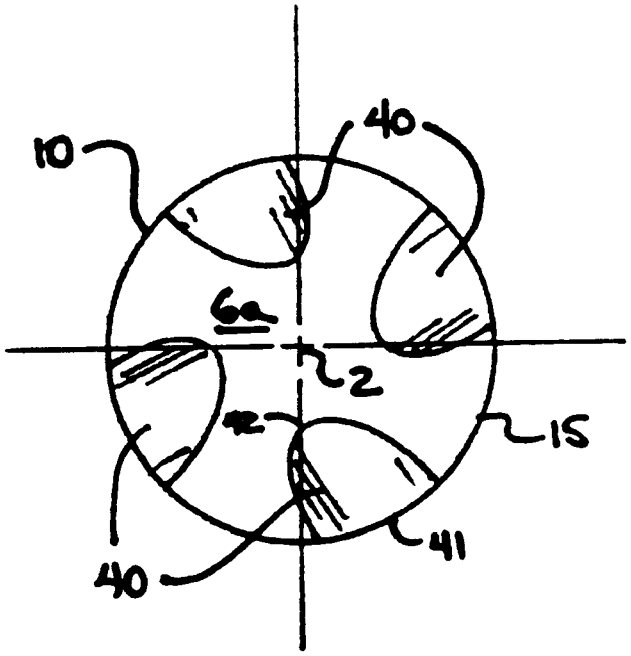
FIG. 4B shows a detailed view of another exemplary embodiment having inlet flow conditioning vanes that lean in the circumferential direction.

In another embodiment shown in FIG. 4B, the inlet flow conditioning vanes 40 have lean or are leaned in a circumferential direction to provide an acoustic benefit. As shown in FIG. 4B, four inlet flow conditioning vanes 40 extending inward from the inside circumference of the outer casing 10 and the individual inlet vanes 40 are leaned in the circumferential direction. The reason for this is that fluid wakes from the inlet vanes 40 may interact with the impeller blades 28 and the interaction of these wakes can be minimized and the vibration that they cause can be reduced by leaning the inlet vanes 40 in certain applications.

Preferably, the inlet flow conditioning vanes 40 are evenly spaced around the circumference of the outer casing 10 and the flow stream. For example, if three inlet flow conditioning vanes 40 are used, then the inlet vanes 40 are preferably disposed 120 degrees apart; if four inlet flow conditioning vanes 40 are used, then the inlet vanes 40 are preferably disposed 90 degrees apart; etc.

Figure 5:
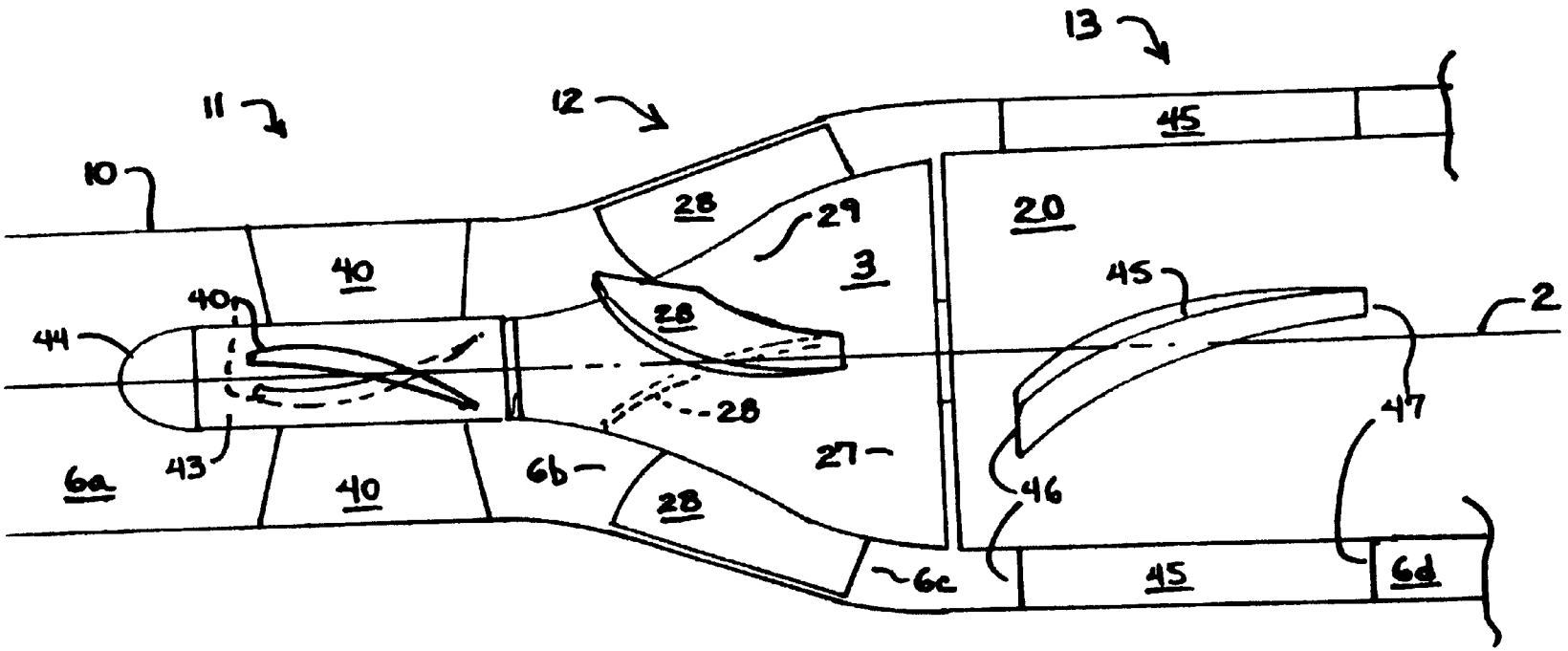
FIG. 5 shows another exemplary embodiment having curved inlet flow conditioning vanes and a center body.

The inlet flow conditioning vanes 40 may include a cantilever design wherein the vanes span a portion of the inlet duct 15 (e.g., extend into the fluid flow), or a beam-like design wherein the inlet vanes 40 span the entire inlet duct 15, such as in embodiments shown in FIG. 5 having a center member 43 arrangement. Although not required, the inlet flow conditioning vanes 40 preferably extended a radial distance into the flow stream substantially equal to the radius of the flow stream to maximize the flow conditioning of the inlet flow stream.

FIG. 5 shows an alternative embodiment further including a center member 43 or fairing coincident with the central body 20 and the axis of rotation 2 of the pump impeller 21 and having the inlet flow conditioning vanes 40 connected to the center member 43. The center member 43 extends axially along the longitudinal centerline axis 2 of the mixed flow pump 1 from the central body 20 forward toward the inlet section (e.g., into the inlet flow). Preferably, the center member 43 includes a faired forward end with a hydrodynamic fairing to allow smooth flow over and around the center member 43 and central body 20 and into the impeller blades 28.

Figure 6A:
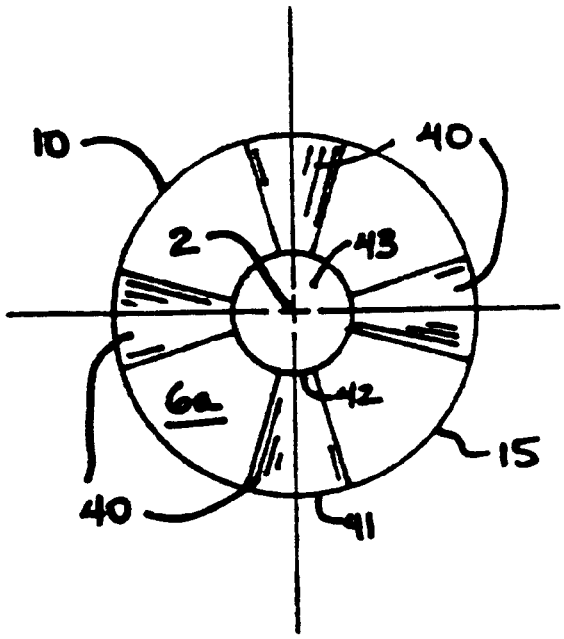
FIG. 6A shows exemplary inlet flow conditioning vanes extending radially inward from the inside circumference of the outer casing to a center member.

FIG. 6A shows four inlet flow conditioning vanes 40 having a cantilever type design wherein the inlet flow conditioning vanes 40 extend inward from the inside circumference of the outer casing 10 along a radial line extending generally radially to a center member 43 at the longitudinal centerline axis 2.

Figure 6B:
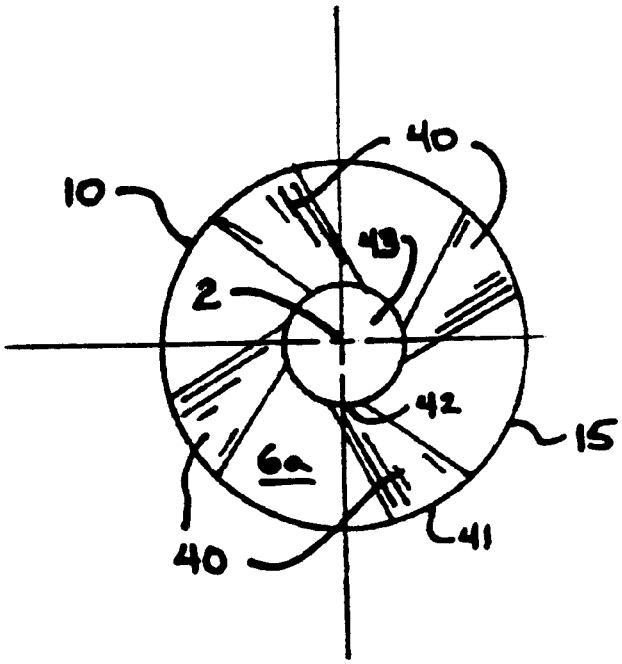
FIG. 6B shows a detailed view of another exemplary embodiment having inlet flow conditioning vanes that lean in the circumferential direction as they extend between the outer casing and the center member.

FIG. 6B shows exemplary inlet flow conditioning vanes 40 that are leaned in a circumferential direction to provide an acoustic benefit. As shown in FIG. 6B, four inlet flow conditioning vanes 40 extending inward from the inside circumference of the outer casing 10 to a center member 43 and the individual inlet vanes 40 are leaned in the circumferential direction.

The center member 43 may be an independent structure free of the center body 20, or, preferably, the center member 43 is connected to the center body 20. As shown in FIG. 5, the center member 43 is stationary and a shaft (not shown) extends between the center body 20 and the center member 43 and supports the rotating impeller 21. Bearings (not shown) can be located at the forward end and after end of the pump impeller 21 to allow the impeller 21 to rotate. This embodiment having a center member 43 provides additional structural support for the outer casing 10, center body 20, and impeller 21. A mixed flow pump system 1 having a center member 43 makes the mixed flow pump system 1 more rugged and resistant to shock and vibration.

FIGS. 1 and 5 show curved inlet flow conditioning vanes 40. As shown in FIGS. 1 and 5, the inlet flow conditioning vanes 40 are generally shaped as a foil or wing, but other shapes may be used depending on the particular application. In one embodiment shown in FIG. 1, the inlet flow conditioning vanes 40 can be oriented to curve or turn in the same direction as the direction of impeller 21 rotation, which reduces the relative velocity thereby reducing cavitation.

In another embodiment shown in FIG. 5, the inlet flow conditioning vanes 40 can be oriented to curve or turn into the direction of impeller 21 rotation, which results in increasing the relative velocity of the fluid flow enter the pump impeller 21 and increasing the head rise potential of the pump.

Figure 3:
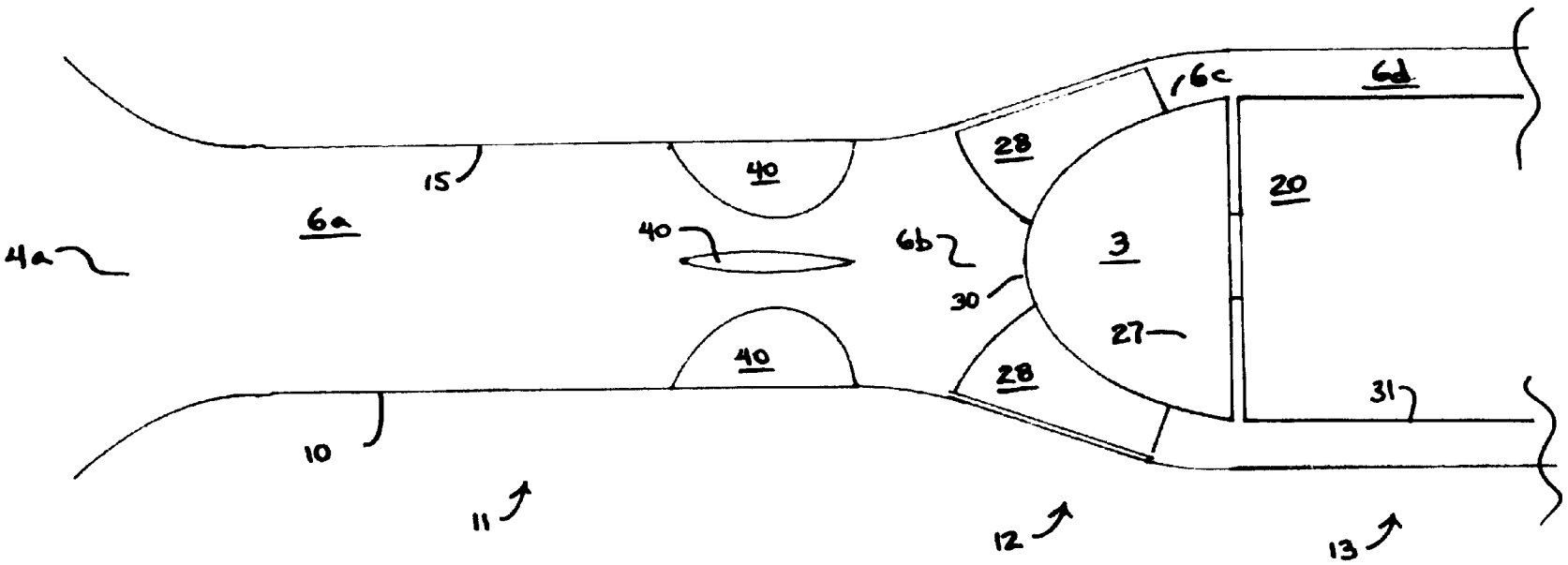
FIG. 3 shows a detailed view of an exemplary embodiment having straight inlet flow conditioning vanes.

In yet another embodiment shown in FIG. 3, the inlet flow conditioning vanes 40 can be straight vanes having a span (e.g., length) that is aligned with the longitudinal centerline 2, which tends to take distortions out of the inlet flow.

The shape, number, size and exact position of the inlet flow conditioning vanes 40 can be varied to optimize these parameters and achieve the desired flow conditioning for the particular application. The vanes may span a portion of the duct as shown in FIGS. 1 and 3, or the entire duct, as shown in the center member 43 arrangement of FIG. 5. For example, the shape, number, size, and position of the inlet flow conditioning vanes may be determined by the degree of swirl required to reduce the relative flow velocity at the impeller eye and thereby reduce cavitation and noise. Alternatively, the shape, number, size, and position of the inlet flow conditioning vanes may be determined to increase the relative flow velocity of the fluid flow entering the impeller thereby improving the head of the pump.

Central Body

As shown in the Figures, the mixed flow pump system 1 includes a central body 20 disposed within the outer casing 1O and that is coincident with the centerline axis 2 or axis of rotation of the pump impeller 21. The central body 20 is align along and extends axially along the longitudinal centerline axis 2 of the pump outer casing 10 from the impeller section 12 and into the outlet section 13.

The central body 20 includes a stationary portion and the rotating rotor or mixed flow pump impeller 21. The central body 20 may include a solid body or a hollow shell body. Preferably, the central body 20 includes a faired forward end 30, as part of the rotating impeller 21, a generally cylindrical mid-section 31 and a faired after end 32, as part of the stationary portion, to allow smooth flow over and around the central body 20.

The central body 20 has a smaller cross-sectional area than the outer casing 10 and is disposed within the outer casing 10. Annular flow passage 6*d* is defined between the outer casing 10 and the central body 20. Preferably, the shape of the central body 20 corresponds to the shape of the outer casing 10.

Impeller Section

The impeller section 12 is disposed between and connects the inlet section 11 and the outlet section 13. As shown in the Figures, the impeller section 12 includes a mixed flow pump 3 having a pump impeller 21 rotatably connected to the central body 20. The mixed flow pump impeller 21 is used to increase the energy of the fluid flow contained internal to the outer casing 10. The mixed flow pump 3 is used to draw a fluid from one of an internal and an external fluid environment into the inlet of the mixed flow pump system 1. The mixed flow pump 3 is used as a means of adding hydraulic energy to the fluid in order to generate thrust.

The mixed flow pump impeller 21 includes a hub 27, blades 28, and flow passageways 29. The inlet of the pump is preferably designed to receive a flow of fluid and preferably includes a fairing 30 at the impeller hub to allow smooth flow entry into the impeller blades 28 and passages 29. The hub 27 holds the impeller blades 28 in place and rotates as an assembly connected by a shaft (not shown) to a drive source 50, such as an electric motor or other motive device.

Referring to FIG. 1, the impeller 21 can be rotating in a counter clockwise direction looking aft from the forward end or inlet end of the mixed flow pump impeller (e.g. in the direction of arrow 35). As shown, the impeller 21 includes four impeller blades 28 and the impeller blades 28 are turned into the same direction as the rotor rotation (e.g., the closest side rotates upward in the counter clockwise direction). Accordingly, the blades 28 are turning the flow in the same direction as rotor rotation (arrow 35).

The impeller 21 rotates within the impeller sweep. The impeller sweep is defined by the span (e.g., longitudinal length) of the impeller blades 28. The impeller rotation is causing the flow to rotate in the same direction as the direction of rotation of the impeller 21. The stator vanes 45, which are located down stream of the impeller 21, are removing that swirl from the exiting flow and causing the flow to turn back to the parallel or axial orientation again (e.g., parallel to the centerline axis 2).

The mixed flow pump impeller 21 rotates within the outer casing 10. The term "mixed flow" is meant to include its common meaning in the art that the impellers are neither pure radial impellers nor pure axial impellers. The increased energy provided by the mixed flow pump 3 results in higher pressure in the flow, resulting in thrust being produced as the flow exits the propulsor.

The mixed flow pump 3 preferably covers the entire range between a pure radial pump and a pure axial pump. In other words, mixed flow preferably lies on a continuum between, but not including, 100% radial to 100% axial. The mixed flow pump 3 exists in a range between pumps considered axial and pumps considered radial. For example, a pump is radial if the axial velocity at the discharge is zero. If there is any positive radial flow at the discharge, then the pump is a mixed flow pump.

Mixed flow pumps allow for a lower internal velocity propulsor and consequently improved cavitation and acoustic performance. Also, mixed flow pumps do not break down in cavitation and therefore, even through the wetted surfaces of the mixed flow pump system 1 may be greater than a convention external propulsor, the internal mixed flow pump system 1 of the present invention has a higher efficiency over the whole range of impeller devices.

For example, while cavitation issues may limit the achievable speed of conventional external propulsors (e.g., cavitation won't produce thrust), a vehicle having an internal mixed flow pump system 1 of the present invention can achieve higher speeds because cavitation is not an issue. Also, a vehicle having an internal mixed flow pump system 1 can not only achieve higher speeds than conventional propulsors, but can achieve higher speeds without making additional noise or vibration.

Figure 7A:
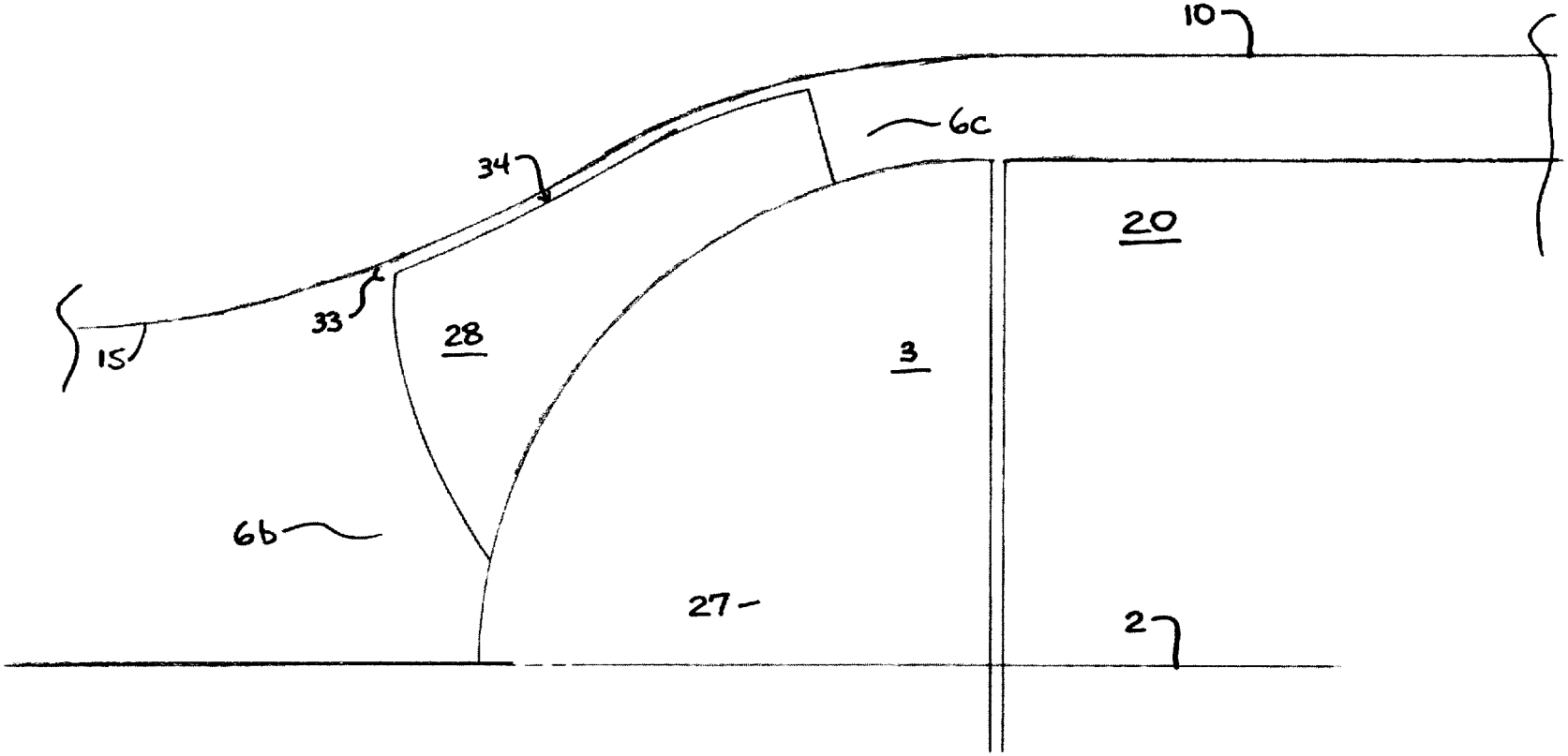
FIG. 7A shows a detailed view of an exemplary open impeller blade that can be used with the mixed flow pump of FIG. 1.
Figure 7B:
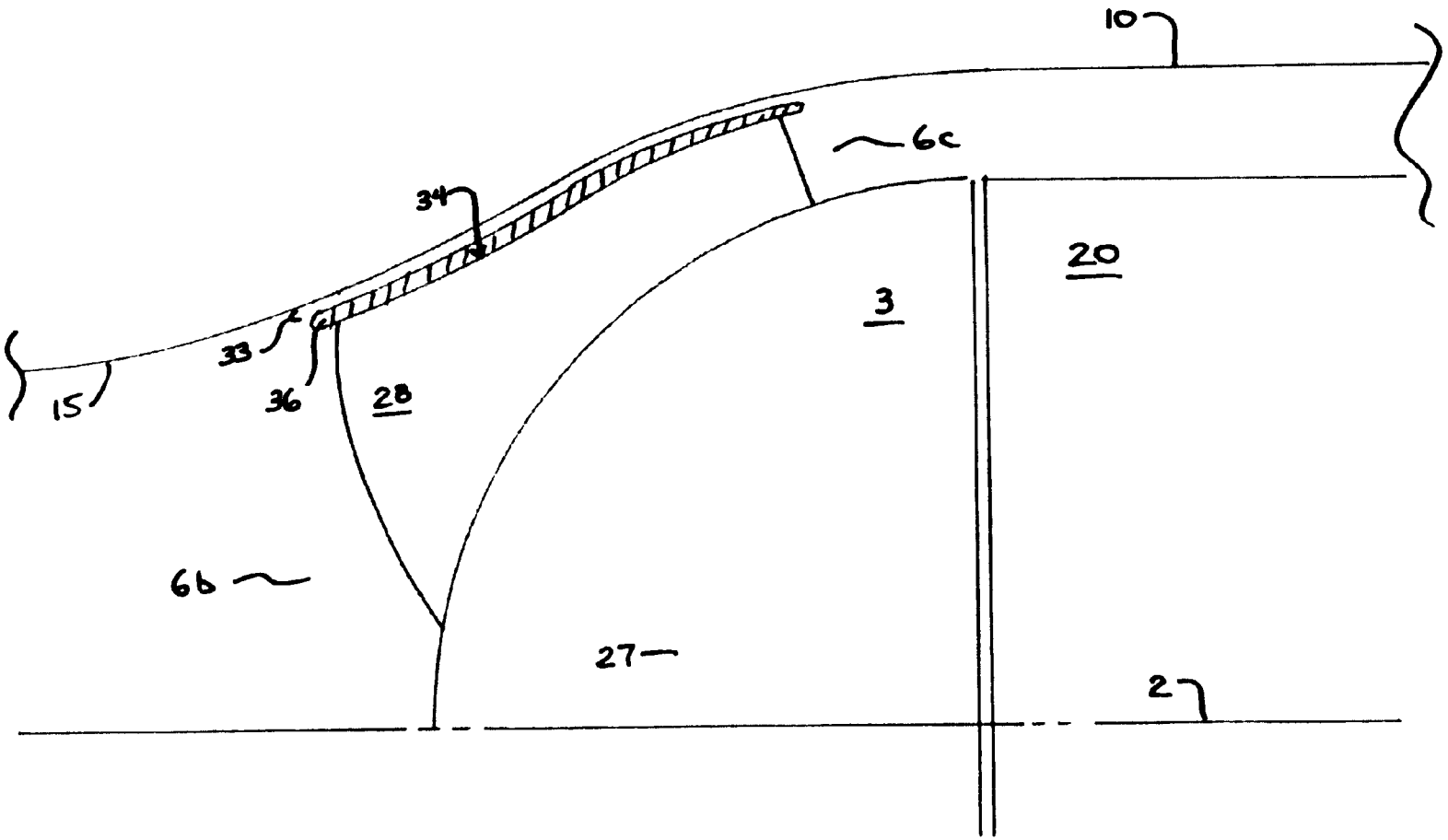
FIG. 7B shows a detailed view of an exemplary shrouded impeller blade that can be used with the mixed flow pump of FIG. 1.
Figure 7C:
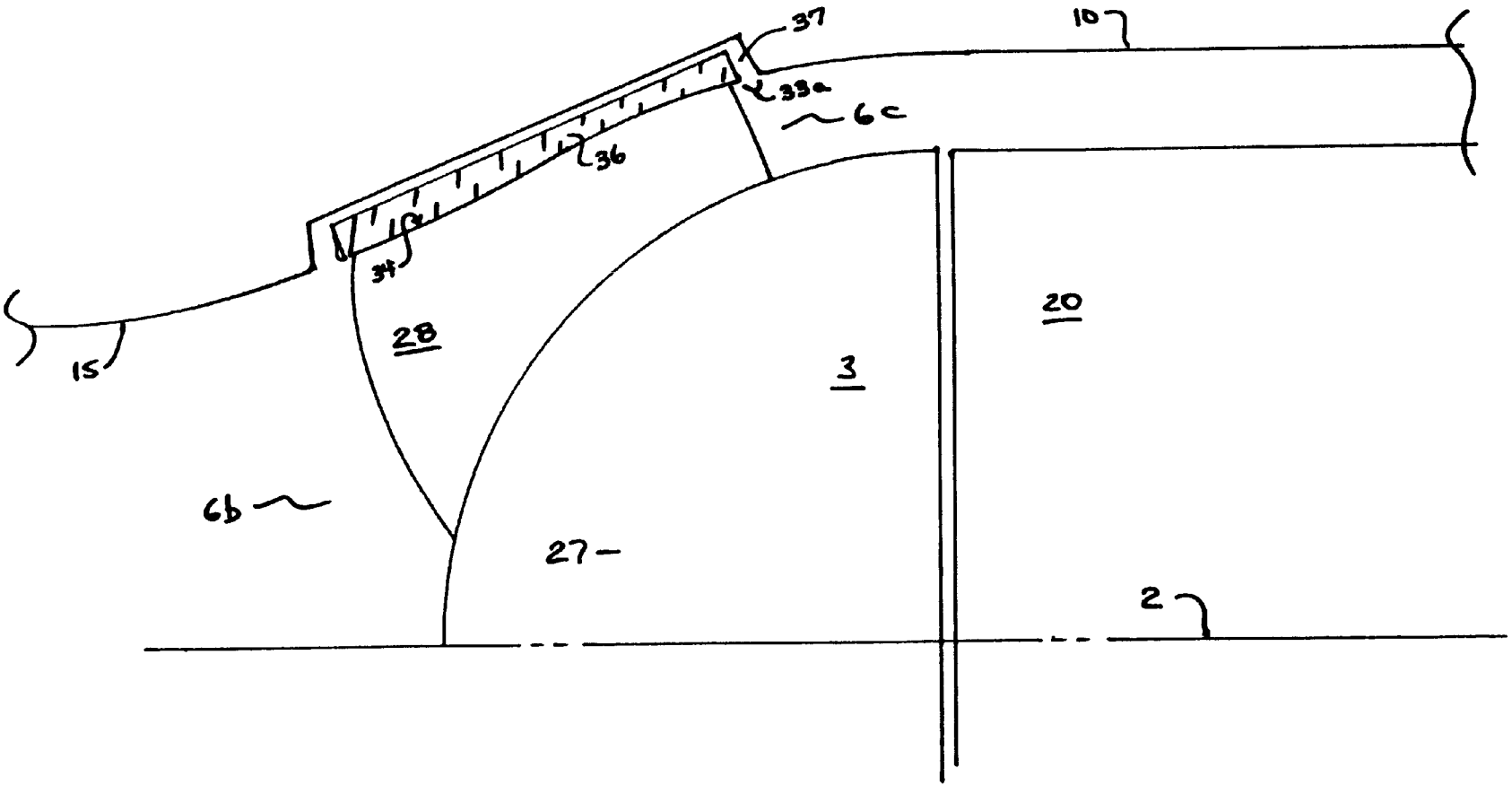
FIG. 7C shows a detailed view of an exemplary embedded shrouded impeller blade that can be used with the mixed flow pump of FIG. 1.

As shown in FIGS. 7A, 7B, and 7C, the pump impeller 21 may include an open, a shrouded, or an embedded shroud design. FIG. 7A shows a pump impeller 21 having an open blade construction. As shown in FIG. 7A, with an open blade pump the impeller blades extend outward from the hub 27 of the impeller 21 and a gap 33 exists between the tips 34 (e.g., distal ends) of the blades 28 and the outer casing 10. In each of these configurations, a small clearance gap 33 exists between the tip 34 of the rotating impeller blades 28 and the outer casing 10.

FIG. 7B shows a shrouded impeller blade design. As shown in FIG. 7B, a shroud 36 may be attached to the tips 34 of the impeller blades 28 to provide additional flow conditioning, structural support, and/or cavitation resistance. The shroud 36 at the tip 34 of each blade 28 is connected to and rotates with the impeller blade 28. Again, a small gap 33 exists between the tip 34 of the rotating impeller blades 28 and the outer casing 10.

In addition, the mixed flow pump 3 may include an embedded shroud (or trenched shroud) design as shown in FIG. 7C. As shown in FIG. 7C, the shroud 36 may be recessed into a groove 37 in the outer casing 10 in order to maintain a smooth flow surface connecting the outer casing 10 and the inside surface of the shroud 36. Preferably, the inside surface of the outer casing and the inside surface of the shroud form a substantially continuous or smooth surface, except for the small gap 33*a* between the groove 37 and the shroud 36. Since this small gap 33*a* is so small and is oriented perpendicular to the direction of fluid flow, the flow substantially jumps over the small gap 33*a*.

Stator Vane Assembly

The mixed flow pump system 1 includes a stator vane assembly disposed in the outlet section 13 downstream of the mixed flow pump 3. The stator blade assembly includes a plurality of individual, stationary stator blades 45 that are connected at one end to the outer casing 10 and connected at the other end to the central body 20. The stator blades 45 provide structural support for the central body 20 within the outer casing 10. Preferably, the stator blades 45 extend radially between the outer casing 10 and the central body 20 to provide flow conditioning of the fluid flow exiting the rotating impeller 21 convert rotational energy imparted to the fluid flow by the impeller blades into axial flow energy after the stator vanes 45.

As shown in FIGS. 1 and 5, the stator blades 45 preferably include shaped blades to remove swirl imparted to the flow by the mixed flow pump impeller 21. This feature operates to convert the kinetic energy contained within the swirl velocity to pressure which is then available as thrust from the mixed flow pump system 1. Optimum performance is achieved when all flow swirl velocity is removed from the fluid flow. Preferably, the stator vanes 45 are hydrodynamically matched to the mixed flow pump impeller 21 to maximize the removal of swirl velocity from the flow exiting the impeller 21.

Preferably, the stator blades 45 are generally foil or airfoil shaped blades, however their exact shape, size, position and number can vary. As shown, the stator vanes include a first or forward end 46 and a second or aft end 47 located downstream of the forward end 46. As shown, the stator vanes 45 can include a greater thickness at the first end 46 and may taper down to a smaller thickness at the second end 47.

The stator blades 45 are preferably evenly spaced around the circumference of the inside of the outer casing 10 and the outside of the central body 20. The span of the stator vanes 45 is determined based on the desired flow conditioning (e.g., the span of the stator vanes 45 may be related to the degree of swirl they must remove from the flow exiting the impeller 21 to ensure a smooth discharge flow).

Outlet Section

As shown in FIG. 1, the outlet section 13 includes outlet ducting 24 for containing and guiding a flow of fluid from a first end of the outlet ducting 24 at the pump outlet 6*c* of the mixed flow pump 3 through the outlet section 13 to a second end of the outlet ducting 24 at the system outlet opening 4*b*. The outlet ducting 24 includes the annular axial discharge passage 6*d* between the outer casing 10 and the first portion 8*a* of the central body 20, a transition section proximate the second portion 8*b* of the central body 20 where the outer casing 10 converges and the central body 20 fairs down to a nozzle 25.

Preferably, the outlet ducting 24 has a generally circular cross-section, although other shapes may be suitable. In addition, the outlet ducting 24 preferably includes a generally decreasing cross-sectional area from the first end to the second end for causing an acceleration of the fluid flow passing there through.

In embodiments having outlet ducting 24 having a generally decreasing cross-section, flow may be accelerated by progressively decreasing the flow area to increase the flow velocity, thereby providing a high velocity fluid flow to produce thrust. This can be accomplished, for example, by gradually decreasing the diameter of, for example, a circular shaped outer casing 10 over the length of the outlet section 13.

Discharge Nozzle

As shown in FIG. 1, the mixed flow pump system 1 can include a discharge nozzle 25 located proximate the system outlet opening 4*b* for discharging the high-energy fluid flow from the mixed flow pump system 1 to produce thrust.

Thrust is produced by the acceleration of the flow from the mixed flow pump impeller 21 and in the discharge nozzle 25. High pressure in the flow is converted to velocity in a flow jet, with the change in linear momentum being related to the net thrust produced. The discharge of the nozzle 25 may be circular, elliptical, rectangular, or other shapes as required, to interface with a particular application in an optimum manner.

In addition, a thrust vectoring mechanism 60 can be used to direct the thrust in the desired direction. This can be accomplished by vectoring the discharge nozzle 25, vectoring a pod or module housing the mixed flow pump system 1, and the like.

Preferably, smooth flow is maintained from the discharge of the stator assembly to the discharge nozzle 25 of the mixed flow pump system 1. In addition, it is preferred that the shape of the outer casing 10 and the shape of the central body 20 are such that constant area or a smooth variation in flow area is maintained throughout the internal flow passage 6*a*–6*e*. To this end, the mixed flow pump system 1 preferably includes one or more fairings at a forward end of the central body 20 (e.g., at the impeller 21), a forward end of the center member 43, and the after end of the central body 20 in order to facilitate smooth flow through the internal flow passage 6*a*–6*e* and over/around the central body 20.

Drive Source

The mixed flow pump system 1 includes a drive source 50 for driving the mixed flow pump 3 and causing the pump impeller 21 to rotate and impart energy to the fluid flowing through the mixed flow pump system 1. The drive source can include a motor 50 that provides a driving force to rotate the mixed flow pump impeller 21. In a preferred embodiment shown in FIGS. 1 and 8, the motor 50 is aligned along the longitudinal centerline axis 2 of the mixed flow pump system aft of the mixed flow pump 3 and in the flow stream.

In an embodiment having the drive source 50 positioned internal to the fluid flow, the drive source 50 can be housed in the central body 20 and electrical power lines (not shown) to the motor may extend through one of the stator vanes 45. In a preferred embodiment, the motor 50 includes a high energy density motor.

In an alternative embodiment (not shown), the motor 50 may be located external to flow stream. For example, the motor 50 may be located on the exterior of the outer casing 10 and a drive shaft and gears, such as a right angle drive and a set of beveled gears, can be used to connect the output shaft of the motor 50 to the input shaft of the mixed flow pump impeller 21. In another embodiment (not shown), the drive source could include a rim drive motor. For example, a rim drive motor could be attached to the shroud or embedded shroud and exist outside the outer casing. Bearings in the central body 20 fairing could be provided to support the rotor in the rim driven assembly.

Operation

The design and operation of the mixed flow pump system 1 can also be described in terms of the flow of liquid through an exemplary system, such as the exemplary mixed flow system 1 of FIG. 1. In one exemplary system, the flow begins at the system inlet 4*a* and flows in the inlet flow passage 6*a* through circular inlet ducting 15. The flow then optionally conditioned as it passes through the inlet flow conditioning vanes 40. Once past the inlet flow conditioning vanes 40, or concurrently therewith, the diameter of the inlet ducting 15 preferably increases gradually.

The fluid flow enters the pump impeller 21 through the pump inlet 6*b* and passes through the impeller passageways 29 and exits out of the pump outlet 6*c*.

The flow becomes annular as the flow exits the impeller passageways 29 and enters the annular flow passage 6*d* of the outlet ducting 24, which, in this exemplary embodiment, also has a circular cross section. The flow continues in an annular manner around the motor/impeller housing (e.g., the central body 20) to a maximum cross section diameter for the pump casing 10 and then flow continues aft through the annular flow passage 6*d* while the circular cross section of the outlet duct 24 preferably decreases in diameter gradually.

Prior to entering a transition area, and typically near the maximum cross section diameter, the flow passes through foil-like blades or stator vanes 45 that eliminate tangential flow (swirl) and provide support for the motor/impeller housing 20. Flow then transitions from the annular flow back to a flow of circular cross section as the flow passes the end of the motor/impeller housing 20 and into the outlet flow passage 6*e*. Flow then exits the system outlet 4*b*, preferably through an outlet nozzle 25, to provide thrust.

Figure 8:
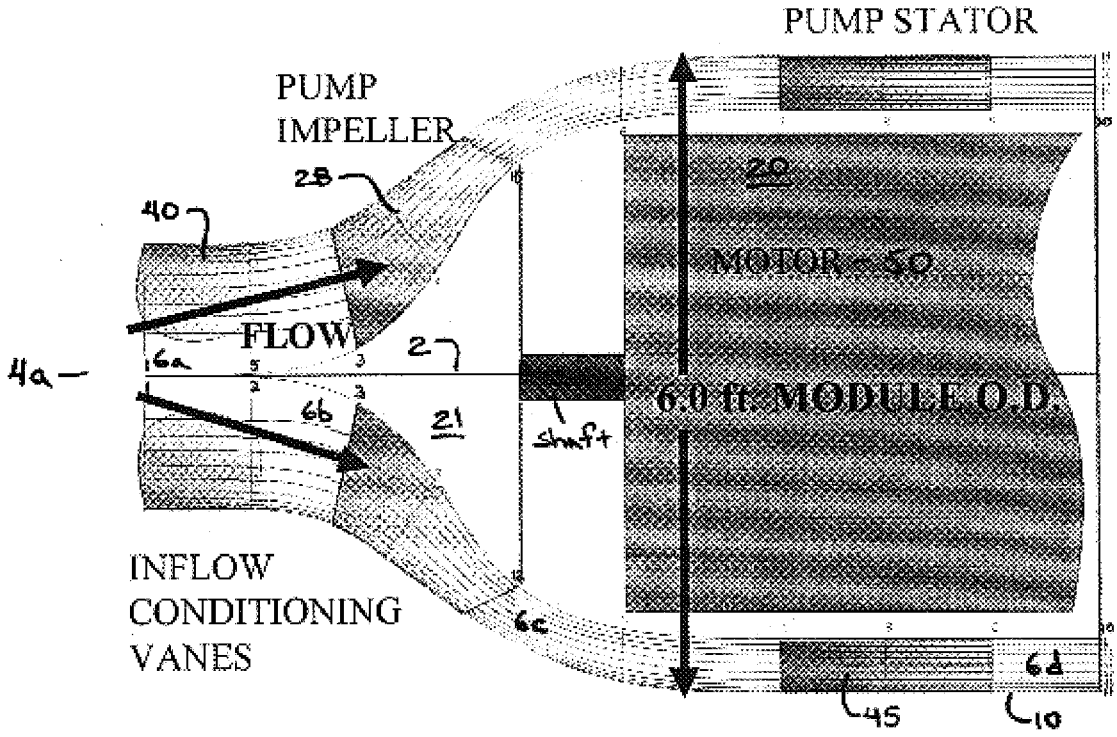
FIG. 8 shows a schematic view of an exemplary impeller and drive motor of the mixed flow pump of FIG. 1 illustrating the flow through the mixed flow pump.

In another exemplary embodiment, where the co-axial mixed flow pump system 1 includes an axial forward looking inlet and is operating in an external fluid environment, such as the exemplary mixed flow pump system 1 of FIG. 8, the production of thrust can be accomplished as follows: A quantity of flow enters the system inlet 4*a* at some velocity, nominally slightly lower than the speed of the vehicle to which the mixed flow pump system 1 is installed. The flow is diffused in the inlet to increase its pressure. In one embodiment, some swirl may be added by inlet flow conditioning vanes 40 to reduce the velocity of the flow as it enters the pump impeller 21. The flow energy or pressure is increased in the rotating pump impeller 21. Energy, for example, in the form of torque and RPM on a motor shaft, is provided to accomplish this. As the flow leaves the pump impeller 21, it exhibits a large value of swirl velocity, nominally a large fraction of the rotational speed of the pump impeller 21. This rotational velocity is removed and converted to additional pressure rise in a set of stationary stator vanes 45. The high pressure flow continues to a contracting nozzle 25 where this pressure is converted into velocity, which is discharged from the nozzle 25 into the fluid surrounding the vehicle, thereby propelling the vehicle through the fluid operating environment.

The velocity of the discharged flow is nominally 1.5 to 3 times the velocity of the vehicle. The mass flow rate times the change in the velocity of the flow from the inlet to the jet is nominally equal to the thrust produced by the mixed flow pump system 1. A vectoring mechanism 60 can be provided for moving the nozzle 25 to produce vectored thrust in a desired direction.

Exemplary Applications

The invention has applications in a variety of marine vehicles, including surface crafts, submerged crafts, weapons and unmanned underwater vehicles (UUVs) of various sizes and speed requirements. The propulsion modules may be used as single units or in a distributed propulsion system where additional thrust and enhanced maneuvering may be required. The modules exhibit superior resistance to cavitation due to the use of low RPM mixed flow impellers.

Potential Applications include: conventional surface ships with displacement hulls; air-cushioned bodies (e.g., hover craft); surface ships with strut mounted or pod-propulsors; submersible ships and submarines with internal propulsors or external pod-propulsors; weapons; autonomous/unmanned underwater vehicles; mines; other small submerged vehicles with internal or pod-propulsors; swimmer assist vehicles; maneuvering thrusters, thrust vectored propulsors, harbor tugs; pleasure craft and auxiliary/emergency propulsion; floating platform stabilizers; non-marine hydraulic applications such as: irrigation, fire, water handling and distribution, cooling system pumps, power generation (pumped storage) systems; chemical distribution systems, slurry handling flows, and wells fluid extraction; medical devices such as heart assist pumps, drug infusion pumps, and dialysis pumps; etc.

ADVANTAGES AND NEW FEATURES OF PREFERRED EMBODIMENTS

The mixed flow pump provides several performance enhancements in the areas of inlet flow conditioning, higher pressure thrust propulsion, maneuvering, vibration control, cavitation, and the like.

A significant advantage in cavitation performance and acoustic performance can be achieved by reducing the relative velocity of the fluid flow over the impeller blades. This can be accomplished by use of inlet flow conditioning vanes and/or the use of a low/reduced RPM motor. By reducing the relative velocity, by using one or both of these techniques, the cavitation and vibration noise can be reduced.

The use of a forward looking, axial inlet, as opposed to a flush inlet, provides additional cavitation resistance due to higher available pressure at the inlet to the pump impeller.

The use of flush inlets facilitates installation in some applications with minimum loss of performance.

The use of stator vanes to remove flow swirl velocity creates a condition of the unit having no external torque loads. The use of stator vanes replaces the traditional use of a scroll casing that can cause inefficiency at off-design operation and blade rate tones in the cutoff region of the casing.

The availability of high energy density electric motors makes a smaller diameter unit feasible, consequently, the installation in some applications is facilitated. These high energy density electric motors solves the packaging problems and also allows for lower RPM motors to be used. This provides the advantage of a lower volume and lower RPM resulting in a lower relative velocity at the pump impeller and hence reduced cavitation and vibration noise.

In embodiment employing a rim-type motor located in the fluid flow, motor cooling water can be taken directly from propulsion water stream.

The propulsor can be modular, making installation, repair, and fabrication more economical and reducing downtime or shipyard time wherein the system/ship is out of service for maintenance or repairs.

The production of units of different size or power capabilities makes implementing a distributed propulsion system attractive. This concept increases availability and redundancy compared to a single propulsion plant installation.

Thrust vectoring adds capability in terms of maneuvering and sea-keeping, as well as other potential operating advantages, i.e. small radius turns. A fly-by-wire method of controlling multiple pumps in an application can provide ship stability and high accuracy maneuvering without using conventional control surfaces.

The mixed flow pump units can be installed either internal to a hull or external in pods, or other submerged appendages.

While the invention has been particularly shown and described with reference to preferred embodiments thereof, it will be understood by those skilled in the art that various alterations in form and detail may be made therein without departing from the spirit and scope of the invention. In particular, the specific shape and size of the mixed flow pump, the number and shape of the inlet conditioning vanes, the impeller design, the angle at which the fluid exits the mixed flow impeller from the shaft axis, the specific number and shape of the stator blades, and the means for producing vectored thrust can be altered depending on the specific application without departing from the scope of the invention.

What is claimed is:

1. A co-axial mixed flow pump comprising:

an outer casing having a longitudinal centerline axis;

a central body aligned co-axially within said outer casing along said longitudinal centerline axis;

an axial forward looking inlet formed along said longitudinal centerline axis for receiving a flow of fluid;

a mixed flow pump having a rotating impeller mounted to a forward end of said central body, said mixed flow pump impeller comprising:

a hub;

a plurality of blades extending outward from said hub; and a plurality of flow passages formed between adjacent blades, wherein said mixed flow pump impeller rotates about said longitudinal centerline axis to draw a flow of fluid into said mixed flow pump impeller through said inlet and imparts energy to said fluid flow;

an annular passageway formed between said outer casing and said central body on a downstream side of said mixed flow impeller for receiving said fluid flow exiting said mixed flow impeller, said annular passageway being aligned axially;

a plurality of stator vanes disposed between and connecting said outer casing and said central body to condition said flow exiting said mixed flow pump impeller to flow generally in the axial direction;

an axial rearward looking outlet formed along said longitudinal centerline axis for discharging said flow of fluid from said mixed flow pump.

2. The mixed flow pump of claim 1, further comprising an inlet section extending forward of said axial forward looking inlet, said inlet section having a distal inlet opening at a forward end and a length of inlet ducting connecting said inlet opening to said mixed flow pump impeller.

3. The mixed flow pump of claim 2, wherein a forward portion of said inlet section further comprises a flush inlet.

4. The mixed flow pump of claim 1, further comprising a plurality of inlet flow conditioning vanes disposed in said inlet section to condition a fluid flow flowing into said mixed flow pump impeller, said inlet flow conditioning vanes connected at a first end to said inlet ducting and extending into said inlet ducting to a distal end.

5. The mixed flow pump of claim 4, wherein said inlet flow conditioning vanes comprise straight vanes attached to and extending radially inward from said outer casing to eliminate distortions of said fluid flow.

6. The mixed flow pump of claim 4, wherein said inlet flow conditioning vanes comprise curved vanes that are curved in the same direction as the direction of impeller rotation to impart swirl to the fluid flow entering said mixed flow pump impeller to reduce the relative velocity of the fluid flow to decrease cavitation and vibration noise.

7. The mixed flow pump of claim 4, wherein said inlet flow conditioning vanes comprise curved vanes that are curved into a direction of impeller rotation to impart swirl to the fluid flow entering said impeller and to increase the relative velocity of the fluid flow entering said mixed flow pump impeller to increase said mixed flow pump head rise potential.

8. The mixed flow pump of claim 4, wherein said inflow conditioning vanes extend radially into said inlet duct from said outer casing in a radial direction toward said centerline axis of said outer casing.

9. The mixed flow pump of claim 4, wherein said inlet flow conditioning vanes are leaned in a circumferential direction as said inlet flow conditioning vanes extend into said inlet duct.

10. The mixed flow pump of claim 4, further comprising a center member extending axially forward from said central body into said inlet section, wherein said inlet flow conditioning vanes are extend radially outward from said center member and are attached to said center member and said outer casing.

11. The mixed flow pump of claim 1, wherein said flow enters said mixed flow pump impeller axially, flows through said mixed flow impeller at an angle from said longitudinal centerline axis such that a pressure developed by said mixed flow pump is developed partly by centrifugal force and partly by a lift of said impeller blades on said fluid, and discharges said mixed flow pump impeller axially.

12. The mixed flow pump of claim 1, wherein said mixed flow pump impeller blades further comprise an open blade construction having a clearance gap formed between a distal end of said impeller blades and said outer casing blades.

13. The mixed flow pump of claim 1, wherein said mixed flow pump impeller blades further comprise a shrouded blade construction having a shroud disposed at a distal end of each of said impeller blades.

14. The mixed flow pump of claim 13, further comprising an embedded shrouded blade construction, wherein said shrouds of said shrouded impeller blades extend into and rotate within a groove in said outer casing.

15. The mixed flow pump of claim 1, wherein said drive motor is mounted axially rearward of said mixed flow impeller in said fluid flow.

16. The mixed flow pump of claim 1, wherein said plurality of stator vanes further comprise a curved wing-like shape for removing swirl velocity from said fluid flow exiting said mixed flow impeller and straightening said fluid flow to flow generally in the axial direction.

17. The mixed flow pump of claim 16, wherein said stator vanes are positioned at equal spacing around a circumference of said central body.

18. The mixed flow pump of claim 1, further comprising an inlet fairing that extends forward from a front end of said central body toward said inlet section and provides smooth flow into said impeller section and around said central body.

19. The mixed flow pump of claim 1, further comprising an outlet fairing that extends rearward from a rear end of said central body toward said outlet section, wherein said outlet fairing facilitates a smooth flow as said flow exits said annular passageway.

20. The mixed flow pump of claim 1, further comprising an outlet section having a forward end proximate said axial rearward looking outlet and a length of outlet ducting connecting said annular passageway to a discharge nozzle position in said outlet ducting proximal a discharge opening for accelerating said fluid flow as said fluid flow is discharged from said mixed flow pump.

21. A mixed flow pump for inputting hydraulic energy to a fluid flowing therethrough comprising:

an outer casing aligned axially from a forward end to a rearward end, said outer casing comprising an inlet section, an impeller section, and an outlet section;

said inlet section comprising:

an axially aligned inlet opening at said forward end;

an axially aligned inlet duct having a generally increasing cross-sectional area from a first end of said inlet duct proximal said inlet opening to a second end of said inlet duct;

said impeller section connected to a downstream end of said inlet section, said impeller section comprising:

an axially aligned impeller inlet connected to said second end of said inlet section;

an impeller sweep area having a generally increasing circular cross-sectional area from said impeller inlet to an impeller outlet;

said outlet section connected to a downstream end of said impeller section, said outlet section comprising:

an axially aligned inlet at a forward end of said outlet section connected to said impeller outlet;

an axially aligned outlet duct having a generally decreasing cross-sectional area from said outlet section inlet to a discharge;

a central body disposed within and co-axial with said outer casing, comprising:

a stationary hub disposed within said outlet section;

a mixed flow pump impeller rotatably mounted to a forward end of said hub and in said impeller section for drawing a flow of fluid through said inlet duct and into said mixed flow pump impeller;

an annular passageway formed between said central body and said outer casing and in said outlet section;

a stator blade assembly disposed between and connecting said central body and said outer casing to provide structural support for said central body, to remove any swirl velocity from said fluid flow exiting said mixed flow pump impeller, and to convert kinetic energy contained within the swirl velocity to pressure; and a drive motor for rotating said mixed flow pump impeller.

22. The mixed flow pump of claim 21, further comprising inlet flow conditioning vanes disposed in said inlet section and extending into said inlet duct to condition said flow of fluid into said mixed flow pump impeller.

23. The mixed flow pump of claim 22, wherein said inlet flow conditioning vanes comprise curved vanes having a wing shape, wherein said curved vanes are oriented to curve or turn in the same direction as the direction of rotation of said mixed flow pump impeller thereby reducing the relative velocity of said fluid flow entering said mixed flow pump and reducing cavitation.

24. The mixed flow pump of claim 22, wherein said inlet flow conditioning vanes comprise curved vanes having a wing shape, wherein said curved vanes are oriented to curve or turn into the direction of rotation of said mixed flow pump impeller thereby increasing the relative velocity of said fluid flow entering said mixed flow pump and increasing the head rise potential of said mixed flow pump.

25. The mixed flow pump of claim 22, wherein said inlet flow conditioning vanes extend radially into said inlet duct from said outer casing toward said longitudinal centerline.

26. The mixed flow pump of claim 22, wherein said inlet flow conditioning vanes are leaned in a circumferential direction as they extend into said inlet duct.

27. A co-axial propulsion system comprising:

an outer casing comprising ducting having a longitudinal centerline, said ducting for containing and guiding a fluid flow within said co-axial propulsion system;

a forward looking, axial inlet opening of said outer casing centered about said longitudinal centerline for receiving an axial flow of fluid from one of an internal fluid system and an exterior fluid operating environment into an interior of said co-axial propulsion system;

a rearward looking, axial outlet opening of said outer casing centered about said longitudinal centerline for discharging an axial flow of fluid from said interior of said co-axial propulsion system to one of said internal fluid system and said exterior fluid operating environment;

wherein said ducting extends axially and connects said inlet opening and said outlet opening;

a central body disposed co-axially within said outer casing;

a mixed flow pump impeller rotatably mounted to said central body and disposed co-axially about said longitudinal centerline, wherein an axis of rotation of said mixed flow pump impeller is co-axial with said longitudinal centerline;

an annular passageway defined between said outer casing and said central body, said annular passageway being oriented co-axially about said longitudinal centerline;

a plurality of stator vanes disposed co-axially about said longitudinal centerline and extending radially between said outer casing and said central body and extending through said annular passageway, said stator vanes supporting said central body within said outer casing; and wherein said stator vanes are configured to remove swirl velocity from said fluid flow exiting said mixed flow impeller and straightening said fluid flow to flow in an axial direction toward said outlet opening.

28. The co-axial propulsion system of claim 27, wherein said ducting further comprises inlet ducting formed between said inlet opening and said impeller section and a plurality of inlet flow conditioning vanes disposed in said inlet ducting for conditioning said fluid flow to improve one or more of cavitation performance and acoustic performance of said co-axial propulsion system.

29. The co-axial propulsion system of claim 27, further comprises outlet ducting and a discharge nozzle for discharging said fluid flow from said ducting to produce thrust, wherein said outlet ducting is formed between said impeller section and said outlet opening and wherein said plurality of stator vanes are disposed in said outlet ducting.

30. A co-axial mixed flow pump system comprising:

an outer casing axially aligned about a centerline axis;

a central body disposed within said outer casing and aligned about said centerline axis;

a mixed flow pump rotatably mounted to a front end of said central body and having an axis of rotation that is coincident with said centerline axis;

a plurality of stator vanes disposed between and connecting said outer casing and said central body for removing swirl velocity from a flow exiting said mixed flow pump and causing said exiting flow to flow in an axial direction;

an internal flow passage defined by said outer casing, wherein said internal flow passage further comprising:

an axially inlet flow passage;

an axial inlet to said mixed flow pump;

an axial discharge from said mixed flow pump;

an axially aligned annular flow passage defined between said outer casing and said central body; and an axially aligned outlet flow passage.

* * * * *

UNITED STATES PATENT AND TRADEMARK OFFICE

CERTIFICATE OF CORRECTION

PATENT NO. : 6,692,318 B2
DATED : February 17, 2004
INVENTOR(S) : Mark W. McBride It is certified that error appears in the above-identified patent and that said Letters Patent is hereby corrected as shown below:

Column 2,
Line 14, delete “waterjets” and insert -- waterjet --;
Line 43, delete “caviatation,” and insert -- cavitation, --;

Column 5,
Line 41, delete “casing, A mixed flow” and insert -- casing. A mixed flow --;
Line 49, delete “the” (first occurrence) and insert -- to --;

Column 8,
Line 43, delete “received” and insert -- receive --;

Column 11,
Line 19, delete “1O” and insert -- 10 --;

Column 18,
Line 23, after “vanes” delete “are”.

Signed and Sealed this

Thirtieth Day of November, 2004

JON W. DUDAS
*Director of the United States Patent and Trademark Office*